United States Patent [19]

McCauley et al.

[11] 4,327,798

[45] May 4, 1982

[54] METHOD OF APPLYING FLUX

[75] Inventors: Edward D. McCauley, Columbiana; James C. Farlow; William T. Adams, Jr., both of Birmingham, all of Ala.

[73] Assignee: American Cast Iron Pipe Company, Birmingham, Ala.

[21] Appl. No.: 145,482

[22] Filed: May 1, 1980

[51] Int. Cl.[3] ..... B22D 13/02; B22D 27/18

[52] U.S. Cl. ..... 164/56.1; 164/57.1

[58] Field of Search ..... 164/55, 56, 57, 58, 164/91, 97

[56] References Cited

U.S. PATENT DOCUMENTS

| | | | |
|---|---|---|---|
| 1,521,634 | 1/1925 | Ladd | 164/76 |
| 1,614,862 | 1/1927 | Beatty | 164/56 |
| 1,949,433 | 3/1934 | Russell et al. | 164/20 |
| 2,265,740 | 12/1941 | Morgan | 164/56 |
| 3,303,018 | 2/1967 | Goss | 75/51 |
| 3,863,702 | 2/1975 | Hallerberg et al. | 164/55 X |
| 4,095,643 | 6/1978 | Farlow et al. | 164/57 X |

FOREIGN PATENT DOCUMENTS

| | | | |
|---|---|---|---|
| 1216766 | 12/1970 | United Kingdom . | |
| 1399389 | 7/1975 | United Kingdom . | |
| 394156 | 1/1974 | U.S.S.R. | 164/57 |
| 530737 | 3/1977 | U.S.S.R. | 164/57 |
| 462411 | 12/1977 | U.S.S.R. | 164/55 |

*Primary Examiner*—Robert D. Baldwin
*Assistant Examiner*—J. Reed Batten, Jr.
*Attorney, Agent, or Firm*—Kerkam, Stowell, Kondracki & Clarke

[57] ABSTRACT

A method for introducing fluxing material (flux) into a tubular, centrifugal casting mold in the manufacture of centrifugally cast metallic tubes. The flux is injected directly into the pouring stream of the molten metal in a steady, continuous flow by the pressure from a stream of non-reactive gas such as nitrogen. The injection of the flux into the pouring stream begins only after the wetting of all the casting surfaces of the mold by the molten metal. This flux is supplied from a hopper with a variable speed control auger.

24 Claims, 3 Drawing Figures

METHOD OF APPLYING FLUX

BACKGROUND OF THE INVENTION

I. Field of the Invention

This invention relates to a method for introducing fluxing material into a mold in casting. More particularly the method involves delivering fluxing material into the mold in the manufacture of centrifugally cast steel tubes useful for hydraulic cylinders or similar purposes.

II. Description of the Prior Art

The production of metallic tubes utilizing centrifugal casting molds is well known in the art. These tubes may be pipes or steel tubes used for hydraulic purposes or cast iron pipe, although the casting process usually would include different steps depending on whether steel tubes or cast iron pipes are the desired end product. In the pipe-making process as shown in U.S. Pat. No. 1,949,433, Russell et al, a pouring ladle is generally provided for receiving the molten metal, such as steel or iron, and for accurately pouring a predetermined amount of the molten metal within a predetermined length of time. An inclined trough is positioned to carry the molten metal to the metal mold contained within and rotated by a centrifugal casting machine. The rotating mold within the casting machine is generally surrounded by a water jacket.

Typically the method of casting a metallic tube includes the following steps: first, the ladle and orifice, which may be mounted on a pouring box, are moved to a position whereat the pouring orifice will deposit the molten metal into the mold. Next, the machine ladle is activated whereby it is lifted so the molten metal is discharged into the pouring box. The size of the attached orifice determines the flow rate. The molten metal is discharged along the length of the rotating metal mold, whereby a uniform thickness of the molten metal is deposited upon the interior surface thereof. After the casting has solidified, the tube is extracted from the mold, and the casting cycle, as described above, may be repeated.

The addition of a fluxing material in connection with centrifugal casting techniques is well-known in the prior art and is described, for example, in the patent of Morgan, U.S. Pat. No. 2,265,740, assigned to the assignee of the present invention and disclosing a pipe-making process. The fluxing material is used to form a sealing slag on the inside surface which will contain the impurities that might otherwise be entrapped in the molten metal.

The use of flux also serves to minimize or eliminate lamination defects. A lamination defect results from the sinking of solid oxidized metal films from the inside surface into the wall of the solidifying tube. When solidification occurs on the unsealed inside surface of the tube, the solid metal film is high in oxygen content, because it is exposed to the atmosphere. When this solid metal film sinks into the molten metal, due to its greater density, the deoxidizers in the metal attack the oxygen on the surface of the solidified metal film. The result of this reaction is a plane of inclusions and porosity, which is called the lamination defect. The solidified metal film also traps inclusions which are attempting to float to the inside surface. This is why the solidified film of metal sometimes has two rows of inclusions, one on each side.

By forming a fluid slag which will float on the surface of the molten metal, the flux minimizes oxidation of the molten metal and insulates the molten metal surface, minimizing heat loss to the air. This tends to prevent the formation of a solidified metal film caused by excessive heat loss at the surface of the molten metal. Additionally, the fluid slag which is formed by the flux will contain the impurities which might otherwise be entrapped in the molten metal.

Various techniques for supplying the flux into centrifugal molds have been used in the past. One of these techniques is to supply the flux after all the metal has been poured into the mold. This method is shown, for example, in U.S. Pat. No. 3,863,702 issued to Hallerberg et. al. One of the problems with this technique is that the heat required to melt flux material is extracted from the surface of the molten metal. If enough heat is extracted from the molten metal surface, the surface will cool sufficiently such that a film of metal will solidify thereon, leading to additional lamination problems.

Another prior art technique for introducing flux material is to supply the flux material into the mold just prior to the pouring of the molten metal. A disadvantage of this technique is that the flux material may have a deleterious effect by collecting on the face of the mold.

U.S. Pat. No. 2,265,740, issued to Morgan, describes a technique of supplying a flux material during the pouring of the molten metal into the mold. The molten metal is poured into the slowly rotating mold which serves initially as a trough to distribute the molten metal lengthwise. Upon achieving a lengthwise distribution of the molten metal, the mold is speeded up to distribute a thin layer of molten metal throughout the mold by centrifugal force. Morgan avoids the problem of deleterious contact between the mold surface and flux by delaying the introduction of the flux until this thin layer of molten metal is distributed over all of the interior casting surfaces of the mold. After the mold surface is completely wetted by the molten metal the flux is axially blown into the mold by high energy bursts of air through a nozzle.

Additionally, in the Morgan patent a predetermined initial quantity of fluxing material is placed on the stream of molten metal as it is being poured. This predetermined quantity of fluxing material is used to minimize oxidation at the surface of the molten metal during the pouring period and is small enough to lessen the danger of the fluxing material contacting the mold. In the apparatus used in the Morgan patent, a blast of compressed air is used to distribute the fluxing material into the mold by placing it on the molten metal in the mold. Furthermore, Morgan suggests the use of a rotary blower. However, by blowing the fluxing material into the mold in sudden bursts, surges will occur in the gas lines and the use of such high velocity gases to supply fluxing material may result in a deleterious non-uniform distribution of the fluxing material within the mold.

U.S. Pat. No. 3,303,018, issued to Goss, discloses a method for improving the reaction time between flux and molten metal. The improvement in reaction time between the flux and molten metal in a rotary reactor is accomplished by the use of a series of high pressure gas jets. For example, in FIG. 4 of Goss, a stream of combined molten metal and flux enters the reactor from runner 68, whereat a gas jet emanating from lance 69 impacts the combined stream violently comingling the metal flux. Disadvantageously, the high energy gas breaks up the molten metal, increasing its surface area and exposing it to more oxygen.

U.S. Pat. No. 4,095,643, issued to Farlow et al, and assigned to the assignee of the present invention, discloses an agent feeder for a pipe casting apparatus. That agent feeder uses a relatively low pressure gas to supply chemical agents into the surface of the mold or the surface of the molten metal. Although primarily concerned with the delivery of inoculating or nucleating agents, this patent also suggests the use of the apparatus to supply fluxing material into a molten metal layer formed on the inner surface of a mold.

SUMMARY OF THE INVENTION

It is therefore an object of this invention to provide a new and improved method for feeding fluxing material useful in the treatment of molten metal.

A more particular object of this invention is to provide a new and improved method for feeding fluxing material in a casting method which is most effective in minimizing lamination defects and any deleterious contact between the fluxing material and the face of the mold.

Another object is to provide a new and improved method of introducing flux into a tubular, centrifugal casting mold, whereby the flux is conveyed by a relatively low pressure stream of gas, thus avoiding any surges in the gas lines. The gas is a dry, inert gas, such as nitrogen, to avoid oxidation of the molten metal.

To achieve these and other objects, the present invention provides an improved method for supplying flux in a casting process. In accordance with the present invention, at least a thin layer of molten metal is distributed over the entire interior casting surface of the mold and then the flux is metered directly into the pouring stream of molten metal by injection from a low pressure stream of gas. The addition of flux ends before termination of the flow of molten metal into the mold from the pouring orifice.

BRIEF DESCRIPTION OF THE DRAWINGS

These and other objects and advantages of the present invention will become more apparent by referring to the following detailed description and accompanying drawings, in which.

DESCRIPTION OF THE PREFERRED METHODS

The present method for application of a fluxing material, which produces a protective coating on the molten metal, has been developed to control the oxidation and cooling of the inside surface during the casting and solidification of centrifugally cast metallic or steel tubes. This process improves the quality of centrifugally cast tubes by elimination of the planes of oxides and porosity associated with the lamination defect.

A flux, consisting of a mixture or combination of refractory and metallic oxides of such proportions that the mixture is easily fusible after solidification temperature of steel, is conveyed into the molten metal stream. The preferred flux is two thirds a neutral silicious material, such as Lincoln 780 welding flux, and one third a material to lower the melting point, such as cryolite. However, any material which is low in moisture and will form a molten slag on the surface of the molten metal will work.

Figure 1:
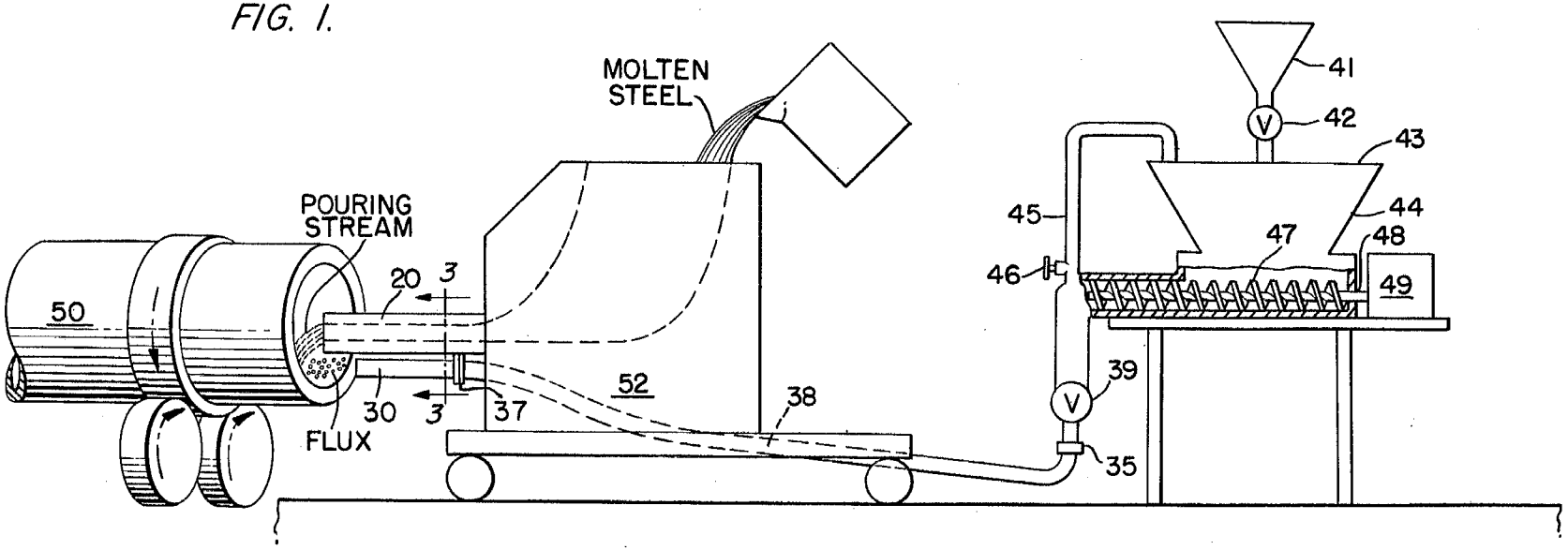
FIG. 1 is a diagrammatic view of apparatus which may be used for carrying out the present method.

The method of the present invention is to be carried out with a centrifugal casting mold as shown generally at 50 of FIG. 1. A pouring stream of molten metal extends from pouring orifice 20 into contact with the inner surfaces of mold 50. The pouring stream is contacted by a stream of flux propelled in a steady, continuous manner through a tube 30 by gas under pressure. The mold 50 is shown axially out of line with orifice 20 only to facilitate a view of the pouring stream. In actual practice the mold 50 and orifice 20 would be in line. The molten metal or steel is delivered to the orifice by a pouring box 52, which may be mounted on a cart, as shown. Flux pipe 30 is coupled to flexible hose 38 by coupling 37. Coupling 35 connects the flexible hose to a hopper conduit 45 which includes a valve 39 and inlet 46 for attaching a pressurized gas source. The flux may be deposited in hopper 41 for delivery through regulating valve 42 and top 43 into the chamber defined by walls 44. The flux is delivered out of the chamber into the gaseous stream of conduit 45 by way of the auger screw 47. The auger 47 is powered by a variable speed motor 49 (speed controls not shown) by way of a shaft shown generally at 48.

Figure 2:
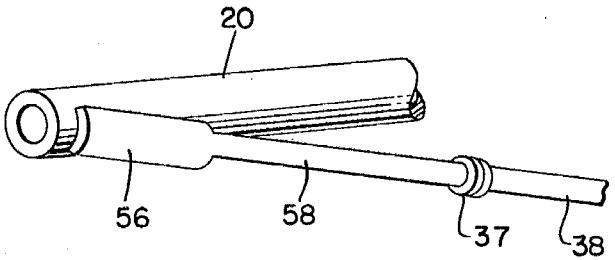
FIG. 2 is a fragmentary view of the pouring orifice with a hand-held lance.

FIG. 2 shows a system for flux application which uses a hand-held or portable lance 58 with spreader shoe 56. Instead of having a mounted flux tube like 30 of FIG. 1, the spreader shoe 56 injects flux while being held adjacent to the orifice 20. As shown, the spreader shoe 56 may be curved to allow the worker to lean it into the outside edge of the pouring orifice 20.

Figure 3:
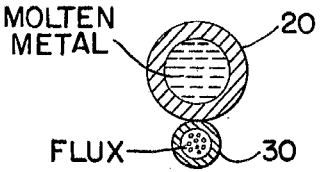
FIG. 3 is an end view in cross-section of the pouring orifice in flux delivery tube, taken along lines 3—3 of FIG. 1.

FIG. 3 shows a cross-section view of pouring orifice 20 and mounted flux tube 30 taken along lines 3—3 of FIG. 1. When pouring the molten metal a fairly constant head is maintained in the reservoir of pour box 52 (FIG. 1), thus providing a steady stream of molten metal throughout the full cross-section of pouring orifice 20.

When the molten metal is initially poured into the mold 50, the metal is uniformly distributed in a radial direction by operation of the centrifugal force caused by the high speed rotation of the mold. If the mold is rotating to set up about a 70 times gravity force, for example, the molten metal will form a thin radial layer coating the inside of the mold. This radial layer, having an annular or ring-like shape, will move down the length of the mold as the pouring continues. Upon the arrival of this molten metal ring at the mold end opposite the pouring end, the casting surfaces of the mold will have been completely wetted. At this moment the flux is introduced without fear of it contacting the casting surfaces of the mold.

The flux is thus injected into the molten metal stream only after the mold surface is completely wetted by the molten metal. The flux is injected into the molten metal stream by the pressure from a stream of non-reactive gas, such as nitrogen. The rate of flux addition is adjusted by a known mechanical device, such as the chamber within wall 44 with variable speed controlled auger 47 of FIG. 1, to deliver into the non-active gas stream an amount of material at a rate which is proportional to the flow rate of molten metal being poured. The flow rate of the non-reactive gas is the minimum necessary to convey the fluxing material to the metal stream. The volume of flux added is controlled by the rate of addition and the duration of the addition. The volume of flux added is sufficient to produce a molten thickness of from $\frac{1}{8}''$ to $\frac{1}{4}''$ thick on the inside of the solidifying tube.

The flux is heated by contact with the molten metal stream in the turbulent flow within the mold during the casting of the mold. The flux is distributed by the turbulent flow of the molten metal during the casting of the mold. Since the flux extracts heat from the molten metal stream, instead of the surface of the molten metal in the mold, the lamination problem is avoided. By ending the flux application at or before the pouring stream is ended, all of the flux will be injected into the molten metal stream instead of being placed onto the molten metal surface.

Instead of using a water jacket to cool the mold, water is sprayed on the outside of mold 50 by sprayers (not shown). This water will speed the solidification of the molten metal in the mold.

Two methods have proven successful in applying the flux material. In Method 1, the material is added over as long a time as is possible; that is, flux is added from the time when the metal has just wetted the entire mold to the time the molten metal stream stops flowing into the mold. The proper amount of fluxing material is added during this time by selecting an appropriate auger speed setting. In Method 2, the amount of fluxing material introduced is controlled by the duration of the time of application, instead of an adjustment to the auger speed. The application of Method 2 starts just after the mold is completely wetted. The application in Method 2 continues until the appropriate amount of fluxing material has been introduced, but always ends before the molten metal stream stops flowing into the mold.

METHOD 1

$\frac{1}{8}''$ Thick Molten Cover Layer of Flux

1. Mix 2–100 lb bags welding flux with 1–100 lb bag cryolite.
2. Load into flux blowing machine.
3. Calculate pouring weight for tube to be fluxed.
4. Select size of pouring orifice.
5. Calculate mold cover time (the time from the start of pouring until the entire mold is wetted).
6. Subtract mold cover time from pouring time to get the time available for supplying the flux, referred to as the blowing time available.
7. Calculate weight of flux required for $\frac{1}{8}''$ thick molten cover layer.
8. Divide weight required by blowing time available to get delivery rate required.
9. Check calibration charts to find auger speed setting to give required delivery rate.
10. Set auger speed on control box.
11. Set nitrogen pressure for minimum required to transport the material through the hose without surging.
12. Pour the molten steel into the mold when the temperature of the steel is approximately 200° F. above the start of solidification.
13. After the metal has wetted the mold completely at the far end of the mold, start injecting flux into the molten metal stream as it exits the pouring orifice.
14. Inject flux at the predetermined rate for the duration of the pour.
15. Stop injecting flux when the molten metal stream stops.

EXAMPLE 1

23.05" OD (outside diameter of pipe)
18.22" ID (inside diameter)
20' long
$2\frac{1}{2}''$ diameter orifice
Mold Cover Time 20 Sec.
Pouring Time 100 Sec.
Blowing Time Available = 80 Sec.
Weight flux Required for $\frac{1}{8}''$ Thickness Cover Layer
9.0475 $In^3$/Inch of Length × 240" = 2171.4 $In^3$
(2171.4 $In^3$/1728 $In^3/Ft^3$) = 1.26 $Ft^3$ × 175 $LB/Ft^3$ = 220 lb Flux Required
Checking the appropriate auger calibration chart indicates that to deliver 220 lbs. of flux in 80 seconds would require an auger speed setting of 8.
This auger speed setting will, of course, vary depending on the calibration chart associated with the particular auger which is being used.

METHOD 2

$\frac{1}{8}''$ Thick Molten Cover Layer of Flux

1. Mix 2–100 lb bags welding flux with 1–100 lb bag cryolite.
2. Load into flux blowing machine
3. Multiply ID of tube to be fluxed by 0.133 for welding flux—cryolite flux
4. Multiply result of (ID × 0.133) by tube length
5. The answer is the blowing time in seconds which will yield a $\frac{1}{8}''$ thickness molten flux layer
6. Set auger speed on control box to 10, the maximum setting
7. Set nitrogen pressure for minimum required to transport the material throughout the hose without surging
8. Pour the molten steel into the mold when the temperature of the steel is 200° F. approximately above the start of solidification
9. After the metal has wetted the mold completely at its far end, start injecting flux into the molten metal stream as it exits the pouring orifice
10. Inject flux for the calculated number of seconds, being careful to stop injecting if the molten metal stream stops

EXAMPLE 2

23.05" OD
18.22" ID
20' Long
$2\frac{1}{2}''$ Diameter Orifice
Mold Cover Time = 20 Sec.
Pouring Time = 100 Sec.
18.22" × 0.133 = 2.42
2.42 × 20 = 48.5 Sec. Blowing Time
(48.5 Sec./60 Sec./Min.) × 270 Lb/Min. = 218 Lb. Flux (Delivered in the 48.5 seconds)

As a comparison of Example 1 and Example 2 will readily show, the difference between Method 1 and Method 2 is that Method 1 uses all of the blowing time available for the insertion of flux, whereas Method 2 injects the flux into the molten metal stream at a higher rate but for a shorter period of time.

Among the possible variations in this process, one could use preheated flux. For example, hose 38 could include a heat exchanger stage to preheat the flux and further reduce the chances of the flux causing lamination through the extraction of heat from the molten metal surface. Alternately, pouring orifice 20 and flux pipe 30 of FIG. 1 could be designed to preheat the flux by conducting heat from the molten metal to the flux.

The process of the present invention is further useful for making dual or multiple layer tubes. For example, one can pour an outer layer initially from one end of the mold, this layer possibly being made of alloys not prone to lamination problems. An inner layer may then be poured from either the same end or the opposite end of the mold with flux being injected at that end in accordance with the present invention.

Although specific materials and steps are contained it the foregoing description, these are not to be used in a limiting sense. More specifically, the use of the word "metal" or "metallic" should be interpreted as including iron and steel, among other materials. Numerous changes may be made in the above-described methods without departing from the spirit thereof. The specifics in the foregoing description being for illustrative purposes only, the scope of the present invention should be determined by reference to the appended claims.

We claim:

1. A method for supplying fluxing material into a centrifugal casting mold for metallic tubes, the steps comprising:

(a) pouring molten metal into one end of a tubular centrifugal casting mold having casting surfaces, thus establishing a pouring stream of molten metal, the casting mold being rotated at a speed such that the molten metal is immediately distributed into an annulus upon contact of the molten metal with the casting mold, this annulus of molten metal moving lengthwise along the mold to the other end;

(b) providing a stream of fluxing material which is injected into the pouring stream of molten metal, the fluxing material entering the mold from said one end and contacting the pouring stream only after the time when the molten metal has wetted the other end of the mold opposite said one end; and (c) maintaining the pouring stream of molten metal at least until a time when the injection of fluxing material is ended.

2. The method of claim 1, wherein the injection of the fluxing material into the pouring stream of molten metal is continued as long as the pouring stream of the molten metal is maintained, thus using all of the blowing time available for the injection of the fluxing material.

3. The method of claim 1, wherein the injection of the fluxing material into the pouring stream of the molten metal is stopped while the pouring stream of the molten metal is maintained, thus using less than all of the blowing time available for the injection of the fluxing material.

4. The method of claim 1 wherein the fluxing material is injected into the pouring stream in a steady, continuous flow.

5. The method of claim 1 wherein the fluxing material is injected into the pouring stream of the molten metal by a stream of gas which causes the fluxing material to mix with the pouring stream.

6. The method of claim 5, wherein the stream of gas is nitrogen.

7. The method of claim 2 or 3, wherein the fluxing material is continuously injected into the pouring stream of the molten metal by a steady stream of gas which causes the fluxing material to mix with the pouring stream.

8. The method of claim 7, wherein the fluxing material is $\frac{2}{3}$ a neutral silicious material and $\frac{1}{3}$ a material which serves to lower the melting point of the fluxing material.

9. The method of claim 2 or 3, wherein the rate of injection of the fluxing material into the pouring stream is controlled by a variable speed auger.

10. A method of supplying fluxing material into a tubular, centrifugal casting mold with casting surfaces, the steps comprising:

(a) pouring molten metal into a tubular, centrifugaL casting mold, thus establishing a pouring stream of molten metal while rotating the casting mold at a speed such that the molten metal is immediately distributed into an annulus upon contact of the molten metal with the casting mold, this annulus of molten metal moving lengthwise along the mold;

(b) injecting fluxing material in a steady, continuous flow directly into said pouring stream of molten metal, said injecting of fluxing material being delayed such that the fluxing material contacts said pouring stream only after the wetting of substantially all of the casting surfaces of the mold, the injection of said fluxing material resulting from the pressure of a stream of gas which causes the fluxing material to thoroughly mix with said pouring stream; and (c) maintaining the pouring stream of molten metal until the injection of fluxing material is ended.

11. The method of claim 10, wherein the injection of the fluxing material into the pouring stream of molten metal is continued as long as the pouring stream of the molten metal is maintained, thus using all of the blowing time available for the conveyance of the fluxing material.

12. The method of claim 10, wherein the injection of the fluxing material into the pouring stream of the molten metal is stopped while the pouring stream of the molten metal is maintained, thus using less than all of the blowing time available for the conveyance of the fluxing material.

13. The method of claim 10, wherein the stream of gas is nitrogen.

14. The method of claim 10, wherein the fluxing material is $\frac{2}{3}$ a neutral silicious material and $\frac{1}{3}$ a material which serves to lower the melting point of the fluxing material.

15. The method of claim 10, wherein the rate of injection of the fluxing material into the pouring stream is determined by a hopper with a variable speed auger.

16. The method of claim 10, wherein the stream of gas is nitrogen, the fluxing material is $\frac{2}{3}$ a neutral silicious material and $\frac{1}{3}$ a material which serves to lower the melting point of the fluxing material, and wherein the rate of injection of the fluxing material into the pouring stream is determined by a variable speed auger.

17. A method of applying fluxing material to molten metal in a tubular, centrifugal casting mold with casting surfaces, the steps comprising:

(a) pouring molten metal into one end of a tubular centrifugal casting mold, thus establishing a pouring stream of molten metal while rotating the casting mold at a speed such that the molten metal is immediately distributed in an annulus upon contact of the molten metal with the casting mold, this annulus of molten metal moving lengthwise along the mold toward its other end;

(b) injecting fluxing material into said pouring stream of molten metal, the injection of fluxing material being delayed such that contact between the fluxing material and the pouring stream occurs sufficiently after the beginning of the pouring such that the molten metal with injected flux will touch only casting surfaces which have already been wetted; and (c) maintaining the pouring stream of molten metal at least until a time when the injection of fluxing material is ended.

18. The method of claim 17, wherein the injection of the fluxing material into the pouring stream of molten metal is continued as long as the pouring stream of the molten metal is maintained, thus using all of the blowing time available for the injection of the fluxing material.

19. The method of claim 17, wherein the injection of the fluxing material into the pouring stream of the molten metal is maintained, thus using less than all of the blowing time available for the injection of the fluxing material.

20. The method of claim 17, wherein the fluxing material is injected into the pouring stream in a steady, continuous flow.

21. The method of claim 17, wherein the fluxing material is continuously injected into the pouring stream of the molten metal by a steady stream of gas which causes the fluxing material to mix with the pouring stream.

22. The method of claim 17, wherein the fluxing material is $\frac{2}{3}$ a neutral silicious material and $\frac{1}{3}$ a material which serves to lower the melting point of the fluxing material.

23. The method of claim 17, wherein the rate of injection of the fluxing material into the pouring stream is controlled by a variable speed auger.

24. The method of claim 19, wherein the injection is started only after the molten metal has wetted the other end of the mold.

* * * * *

UNITED STATES PATENT AND TRADEMARK OFFICE

CERTIFICATE OF CORRECTION

PATENT NO. : 4,327,798

DATED : May 4, 1982

INVENTOR(S) : Edward McCauley et al

It is certified that error appears in the above-identified patent and that said Letters Patent are hereby corrected as shown below:

Claim 24, column 10, line 18, delete "19" and substitute --17--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*